US010474097B2

(12) United States Patent
Namiki et al.

(10) Patent No.: US 10,474,097 B2
(45) Date of Patent: Nov. 12, 2019

(54) IMAGE FORMING APPARATUS, ELECTRONIC STORAGE DEVICE, CARTRIDGE, AND METHOD OF CONTROLLING IMAGE FORMING APPARATUS

(71) Applicant: CANON KABUSHIKI KAISHA, Tokyo (JP)

(72) Inventors: Takayuki Namiki, Yokohama (JP); Naoki Inoue, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/992,267

(22) Filed: May 30, 2018

(65) Prior Publication Data

US 2018/0348702 A1 Dec. 6, 2018

(30) Foreign Application Priority Data

Jun. 6, 2017 (JP) ..... 2017-112026
Mar. 23, 2018 (JP) ..... 2018-056751

(51) Int. Cl.
*G03G 21/18* (2006.01)
*G03G 15/00* (2006.01)

(52) U.S. Cl.
CPC ..... *G03G 21/1892* (2013.01); *G03G 15/5016* (2013.01); *G03G 21/1882* (2013.01); *G03G 21/1889* (2013.01); *G03G 2221/1823* (2013.01)

(58) Field of Classification Search
CPC ..... G03G 21/1892
USPC ..... 399/111
See application file for complete search history.

(56) References Cited

U.S. PATENT DOCUMENTS 6,925,538 B2 8/2005 Niwa et al.
2005/0036795 A1* 2/2005 Karagiannis ..... G03G 15/553 399/27
2007/0079125 A1 4/2007 Adkins
2007/0154228 A1 7/2007 Chan
2010/0254720 A1 10/2010 Ajima
2014/0211241 A1 7/2014 Rice
2016/0154957 A1* 6/2016 Jeran ..... G06F 21/445 713/176

FOREIGN PATENT DOCUMENTS

JP 2007240928 A 9/2007

OTHER PUBLICATIONS

European Search Report issued in corresponding European Application No. 18170024.6 dated Sep. 11, 2018.

* cited by examiner

*Primary Examiner* — Walter L Lindsay, Jr.
*Assistant Examiner* — Philipmarcus T Fadul
(74) *Attorney, Agent, or Firm* — Venable LLP

(57) ABSTRACT

An image forming apparatus to which a cartridge including an electronic storage device can detachably be attached, comprises: an obtaining unit that obtains control information used for image formation from a first area of the electronic storage device and obtain determination information used to determine correctness of the control information stored in the first area from a second area configured to store the determination information; a determination unit that determines the correctness of the control information based on the control information and the determination information; and a control unit that, if the determination unit determines that the control information is correct, controls image formation using the control information obtained by the obtaining unit.

23 Claims, 14 Drawing Sheets

FIG. 4A

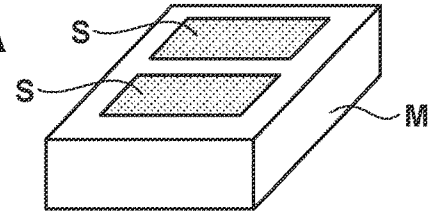

FIG. 4B

| ADDRESS | CONTENTS | INITIAL VALUE | |
|---|---|---|---|
| 01h | DATE OF MANUFACTURE | DATE OF PRODUCTION | |
| 02h | SERIAL NO. | SERIAL NUMBER | |
| 03h | PRINT PAGE COUNTER | 0 PAGE | |
| 04h | TONER REMAINING AMOUNT | 100% | |
| 05h | IDENTIFICATION INFORMATION M3 | 1 | 403 |
| 06h | DETERMINATION INFORMATION M2 | CONVERT Hash VALUE INTO DIGITAL SIGNATURE | 402 |
| ∫ | ∫ | | |
| 11h | CHANGE INFORMATION M1 (TRANSFER CONTROL CHANGE) | -50V | |
| ∫ | ∫ | | 401 |
| 31h | CHANGE INFORMATION M1 (FIXING CONTROL CHANGE) | -9 °C | |
| ∫ | ∫ | | |

FIG. 4C

| ADDRESS | CONTENTS | INITIAL VALUE | |
|---|---|---|---|
| 01h | DATE OF MANUFACTURE | DATE OF PRODUCTION | |
| 02h | SERIAL NO. | SERIAL NUMBER | |
| 03h | PRINT PAGE COUNTER | 0 PAGE | |
| 04h | TONER REMAINING AMOUNT | 100% | |
| 05h | IDENTIFICATION INFORMATION M3 | 0 | 403 |
| 06h | | | |
| ∫ | | | |
| 11h | | | |
| ∫ | | | |
| 31h | | | |
| ∫ | | | |

EARLIER — RELEASE IN MARKET — LATER

| | IMAGE FORMING APPARATUS 100A | IMAGE FORMING APPARATUS 100B | IMAGE FORMING APPARATUS 100C |
|---|---|---|---|
| PROCESS CARTRIDGE 10A | ○ | × | × |
| PROCESS CARTRIDGE 10B | ○ | ○ | × |
| PROCESS CARTRIDGE 10C | ○ | ○ | ○ |

EARLIER — RELEASE IN MARKET — LATER

FIG. 5A

| | IMAGE FORMING APPARATUS 100A | IMAGE FORMING APPARATUS 100B | IMAGE FORMING APPARATUS 100C |
|---|---|---|---|
| TRANSFER BIAS | +1600V | +1550V | +1530V |
| FIXING TEMPERATURE | 220°C | 211°C | 200°C |

FIG. 5B

FIG. 6A

| ADDRESS | CONTENTS | INITIAL VALUE |
|---|---|---|
| 01h | DATE OF MANUFACTURE | DATE OF PRODUCTION |
| 02h | SERIAL NO. | SERIAL NUMBER |
| 03h | PRINT PAGE COUNTER | 0 PAGE |
| 04h | TONER REMAINING AMOUNT | 100% |
| 05h | IDENTIFICATION INFORMATION M3 | 0 |
| 06h | | |
| ∫ | | |
| 11h | | |
| 12h | | |
| ∫ | | |

603

FIG. 6B

| ADDRESS | CONTENTS | INITIAL VALUE | |
|---|---|---|---|
| 01h | DATE OF MANUFACTURE | DATE OF PRODUCTION | |
| 02h | SERIAL NO. | SERIAL NUMBER | |
| 03h | PRINT PAGE COUNTER | 0 PAGE | |
| 04h | TONER REMAINING AMOUNT | 100% | |
| 05h | IDENTIFICATION INFORMATION M3 | 1 | 603 |
| 06h | DETERMINATION INFORMATION M2a | CONVERT Hash VALUE INTO DIGITAL SIGNATURE | 602 |
| ∫ | ∫ | | |
| 11h | CHANGE INFORMATION M1a (TRANSFER CONTROL CHANGE) | -50V | 601 |
| 12h | CHANGE INFORMATION M1a (FIXING CONTROL CHANGE) | -9°C | |
| ∫ | ∫ | | |

FIG. 6C

| ADDRESS | CONTENTS | INITIAL VALUE | |
|---|---|---|---|
| 01h | DATE OF MANUFACTURE | DATE OF PRODUCTION | |
| 02h | SERIAL NO. | SERIAL NUMBER | |
| 03h | PRINT PAGE COUNTER | 0 PAGE | |
| 04h | TONER REMAINING AMOUNT | 100% | |
| 05h | IDENTIFICATION INFORMATION M3 | 2 | 603 |
| 06h | DETERMINATION INFORMATION M2a | CONVERT Hash VALUE INTO DIGITAL SIGNATURE | USED AT TIME OF MOUNTING IN IMAGE FORMING APPARATUS 100B; 602 |
| 07h | DETERMINATION INFORMATION M2b | CONVERT Hash VALUE INTO DIGITAL SIGNATURE | USED AT TIME OF MOUNTING IN IMAGE FORMING APPARATUS 100A; 602 |
| ∫ | ∫ | | |
| 11h | CHANGE INFORMATION M1a (TRANSFER CONTROL CHANGE) | -20V | USED AT TIME OF MOUNTING IN IMAGE FORMING APPARATUS 100B; 601 |
| 12h | CHANGE INFORMATION M1a (FIXING CONTROL CHANGE) | -11 °C | 601 |
| ∫ | ∫ | | 601 |
| 31h | CHANGE INFORMATION M1b (TRANSFER CONTROL CHANGE) | -70V | USED AT TIME OF MOUNTING IN IMAGE FORMING APPARATUS 100A; 601 |
| 32h | CHANGE INFORMATION M1b (FIXING CONTROL CHANGE) | -20 °C | 601 |
| ∫ | ∫ | | |

FIG. 9A

| | IDENTIFICATION INFORMATION M3 = 1 | IDENTIFICATION INFORMATION M3 = 2 |
|---|---|---|
| IMAGE FORMING APPARATUS 100A | 11h | 31h |
| IMAGE FORMING APPARATUS 100B | × | 11h |
| IMAGE FORMING APPARATUS 100C | × | × |

FIG. 9B

| | IDENTIFICATION INFORMATION M3 = 1 | IDENTIFICATION INFORMATION M3 = 2 |
|---|---|---|
| IMAGE FORMING APPARATUS 100A | 11h | 11h |
| IMAGE FORMING APPARATUS 100B | × | 31h |
| IMAGE FORMING APPARATUS 100C | × | × |

FIG. 9C

○ IDENTIFICATION INFORMATION M3 = 1 PROCESS CARTRIDGE

| | REFERENCE ADDRESS |
|---|---|
| MODEL A | 11h |
| MODEL B | — |

FIG. 9D

○ IDENTIFICATION INFORMATION M3 = 2 PROCESS CARTRIDGE

| | REFERENCE ADDRESS |
|---|---|
| MODEL A | 31h |
| MODEL B | 11h |

IMAGE FORMING APPARATUS, ELECTRONIC STORAGE DEVICE, CARTRIDGE, AND METHOD OF CONTROLLING IMAGE FORMING APPARATUS

BACKGROUND OF THE INVENTION

Field of the Invention

The present invention relates to an image forming apparatus, an electronic storage device, a cartridge, and a method of controlling the image forming apparatus.

Description of the Related Art

Conventionally, as for a process cartridge type image forming apparatus, there is known an arrangement in which a developing device, a photosensitive drum, and other process members (a charge means and the like) are integrated in a process cartridge, and the process cartridge is detachably attached to the image forming apparatus main body. With this arrangement, toner replenishment and other maintenance operations can easily be performed.

Since needs of users variously change in recent years, process members in a process cartridge put in a market are also changed in some cases. In this case, process conditions (for example, a transfer bias and a fixing temperature) in image formation need to be changed in accordance with the physical characteristic of the process members.

In Japanese Patent Laid-Open No. 2007-240928, a memory is provided in a process cartridge, and identification information and change data are stored in the memory. Even when a process member is changed, process conditions are corrected to appropriate process conditions in accordance with the identification information, and image formation is performed.

In Japanese Patent Laid-Open No. 2007-240928, however, even if the change data in the memory is erroneously rewritten due to electric noise or the like, the correctness of the change data cannot be determined. For this reason, it may be impossible to form an image under appropriate process conditions and obtain a satisfactory output image. In addition, if the process conditions of the fixing device or transfer device are inappropriate, the interior of the image forming apparatus main body may be contaminated. If high-temperature fixing control or high transfer bias control more than necessary is performed, a formed image may considerably degrade.

Considering the above-described situations, there is still room for improvement/refinement from the viewpoint of determining the correctness of data that is stored in a storage device and used to control image formation.

SUMMARY OF THE INVENTION

According to one aspect of the present invention, there is provided an image forming apparatus to which a cartridge including an electronic storage device can detachably be attached, comprising: an obtaining unit configured to obtain control information used for image formation from a first area of the electronic storage device and obtain determination information used to determine correctness of the control information stored in the first area from a second area configured to store the determination information; a determination unit configured to determine the correctness of the control information based on the control information and the determination information; and a control unit configured, if the determination unit determines that the control information is correct, to control image formation using the control information obtained by the obtaining unit.

According to another aspect of the present invention, there is provided an electronic storage device provided in a cartridge that can detachably be attached to an image forming apparatus, comprising: a first area configured to store control information used for image formation by the image forming apparatus; and a second area configured to store determination information used to determine correctness of the control information stored in the first area.

According to another aspect of the present invention, there is provided a cartridge that can detachably be attached to an image forming apparatus, comprising: an electronic storage device; and a storage unit configured to store a developing material, wherein the electronic storage device comprises: a first area configured to store control information used for image formation by the image forming apparatus; and a second area configured to store determination information used to determine correctness of the control information stored in the first area.

According to another aspect of the present invention, there is provided a method of controlling an image forming apparatus to which a cartridge including an electronic storage device configured to store information can detachably be attached, wherein the electronic storage device includes: a first area configured to store control information used for image formation by the image forming apparatus; and a second area configured to store determination information used to determine correctness of the control information stored in the first area, and the method comprises: deriving first information using control information stored in the first area; determining, based on the first information and the determination information stored in the second area, whether the control information stored in the first area is correct; and if it is determined in the determining that the control information is correct, correcting a control parameter used for image formation using the control information stored in the first area and controlling the image formation.

According to another aspect of the present invention, there is provided an image forming apparatus to which a cartridge including an electronic storage device can detachably be attached, comprising: an obtaining unit configured to obtain identification information used to identify the cartridge from the electronic storage device; and a control unit, wherein the electronic storage device stores first control information for a first image forming apparatus and second control information for a second image forming apparatus of a version different from the first image forming apparatus, the obtaining unit selectively selects control information corresponding to an own apparatus from the first control information and the second control information in the electronic storage device, and the control unit controls image formation using the selected control information.

According to the present invention, it is possible to accurately determine the correctness of the information of an area where change information stored in a storage device is stored and perform appropriate operation control of an image forming apparatus.

Further features of the present invention will become apparent from the following description of exemplary embodiments (with reference to the attached drawings).

BRIEF DESCRIPTION OF THE DRAWINGS

FIGS. 4A, 4B, and 4C are views for explaining the data structure of an electronic storage device according to the first embodiment;

FIGS. 5A and 5B are views for explaining an electronic storage device and an image forming apparatus according to the second embodiment;

FIGS. 6A, 6B, and 6C are views for explaining the data structure of the electronic storage device according to the second embodiment;

FIGS. 9A, 9B, 9C, and 9D are views for explaining an electronic storage device and an image forming apparatus according to the third embodiment.

DESCRIPTION OF THE EMBODIMENTS

First Embodiment

Preferred embodiments of the present invention will now be described in detail. Note that the dimensions, materials, shapes, and relative arrangements of components set forth in these embodiments should be appropriately changed in accordance with the arrangement of the apparatus to which the present invention is applied and various kinds of conditions and do not limit the scope of the present invention to the following embodiments.

[Apparatus Arrangement]

Figure 2:
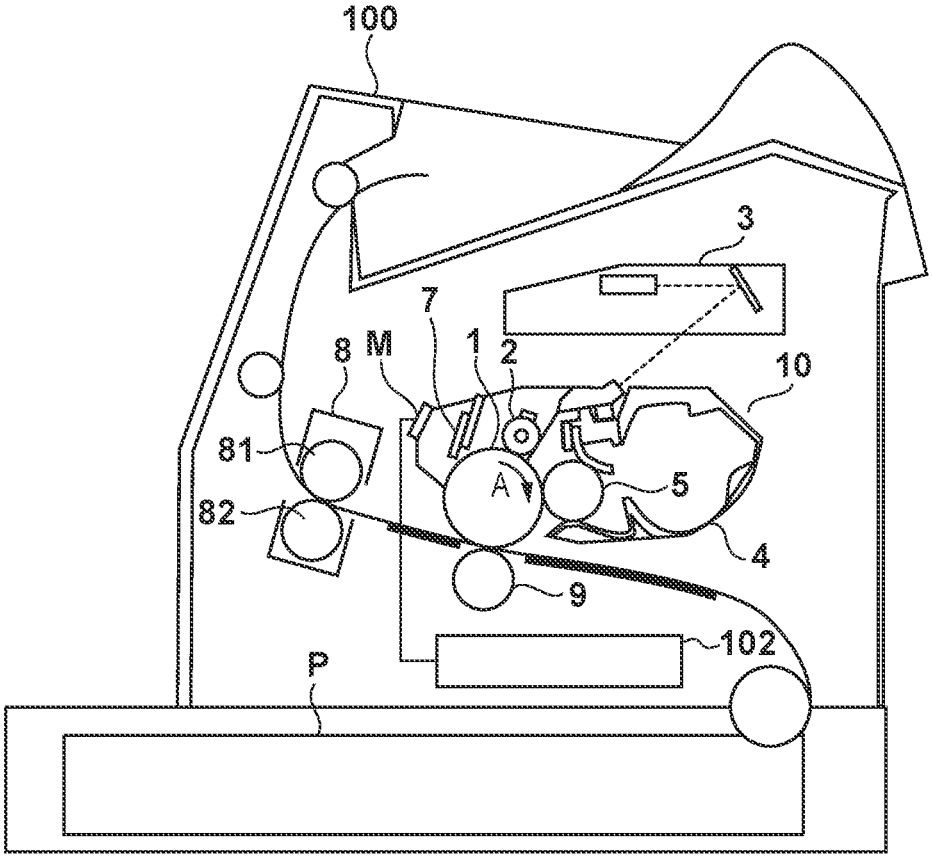
FIG. 2 is a sectional view of a process cartridge type image forming apparatus according to the first embodiment.

FIG. 2 is a view showing an example of the schematic arrangement of a process cartridge type image forming apparatus 100 to which the present invention is applicable. An image forming operation by the image forming apparatus 100 will be described below.

When the image forming operation starts, a photosensitive drum 1 that is an image carrier is rotatably driven in the direction of an arrow A in FIG. 2 by a photosensitive body drive motor (not shown). A charge roller 2 is a charging device that charges the surface of the photosensitive drum 1. A negative voltage is applied from a charging power supply (not shown) to the charge roller 2 at a predetermined timing, thereby evenly negatively charging the surface of the photosensitive drum 1. A laser exposure unit 3 is an exposure apparatus that exposes the charged photosensitive drum 1. The laser exposure unit 3 exposes the photosensitive drum 1 using a laser beam (a broken line in FIG. 2) in accordance with image data, thereby forming an electrostatic latent image. A developing roller 5 is a developing material carrier arranged in a developing device 4 including a storage unit that stores a developing material T (to be referred to as "toner" hereinafter). When a developing bias is applied to the developing roller 5, the electrostatic latent image is developed and visualized as a toner image (developing material image).

The toner image visualized on the photosensitive drum 1 is sent to the contact portion to a transfer roller 9 serving as a transfer device and transferred onto a transfer material P such as paper conveyed in synchronism. Between the transfer roller 9 and the photosensitive drum 1, a power supply (not shown) applies a transfer bias to the transfer roller 9. The toner image transferred to the transfer material P is fixed to the transfer material P by a fixing device 8. In addition, the toner that remains on the photosensitive drum 1 without being transferred is collected by a cleaning device 7. The image forming operation is executed by repeating these steps. Details will be described below.

(Transfer Device)

The transfer roller 9 is provided to face the circumferential surface of the photosensitive drum 1 across the conveyance path of the transfer material P. The transfer roller 9 is formed into a roller shape by a core member made of a metal or the like and an elastic material such as silicone rubber or urethane rubber with a high wear resistance. The transfer roller 9 comes into contact with the photosensitive drum 1 to form a transfer nip portion. A transfer bias can be applied by a power supply (not shown) to the transfer roller 9 via the core member. When the transfer material P is conveyed to the transfer nip portion, the toner image on the photosensitive drum 1 is electrostatically attracted and transferred from the photosensitive drum 1 to the transfer material P. Here, a negatively charged toner is used, and a positive bias of a polarity opposite to the toner is applied as the transfer bias, thereby satisfactorily performing the transfer process.

(Fixing Device)

The fixing device 8 is a device that applies heat and a pressure to the image formed on the transfer material P and fixes the toner image, and includes a fixing belt 81 and elastic pressure rollers 82. The elastic pressure rollers 82 sandwich the fixing belt 81 and form a fixing nip portion of a predetermined width with a belt guide member (not shown) by a predetermined press contact force. In a temperature controlled state in which the fixing nip portion is heated to a predetermined temperature, the unfixed toner image is fixed in a process in which the transfer material P with the unfixed toner image is conveyed through the fixing nip portion.

(Process Cartridge)

In the process cartridge type shown in this embodiment, the photosensitive drum 1, the charge roller 2, the developing device 4 storing the toner T, and the cleaning device 7 are integrated to form a process cartridge 10. The process cartridge 10 is configured to be detachable from the main body of the image forming apparatus 100.

In this embodiment, two process cartridges 10 and 10B will be described as examples. The process cartridge 10 is a process cartridge that stores toner capable of obtaining an optimum image under the control of the above-described image forming apparatus 100 (transfer bias=+1600 V, fixing temperature=220° C.). The process cartridge 10B is a process cartridge that stores toner having a characteristic different from that of the toner stored in the process cartridge 10. In addition, each process cartridge includes an electronic storage device M. Note that a description will be made assuming that the process cartridges have the same structure except the toner.

Although the process cartridge will be described below as an example, the present invention is not limited to this. For example, a development cartridge that includes the toner T and the developing device 4 but not the photosensitive drum 1 can also be used. A developing material bottle (toner cartridge) that does not include rollers may also be used. Alternatively, a photosensitive drum cartridge that does not include the developing device 4 and integrates the photosensitive drum 1, the charge roller 2, and the cleaning device may be used.

(Outline of Control of Image Forming Apparatus)

Figure 3:
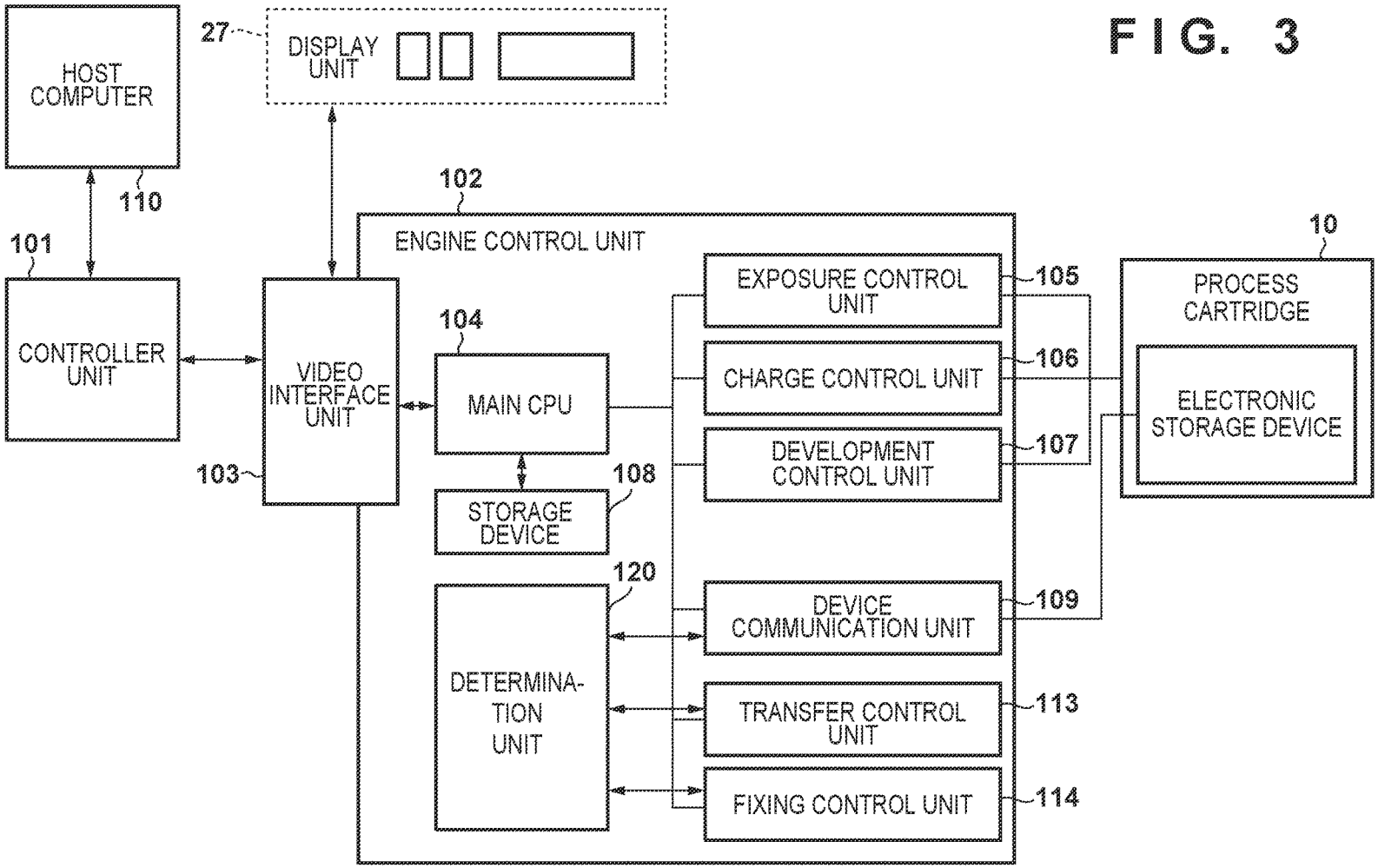
FIG. 3 is a block diagram showing an example of the arrangement of the image forming apparatus according to the first embodiment.

Control according to this embodiment will be described with reference to FIG. 3. In this embodiment, the image forming apparatus 100 and a host computer 110 are communicably connected. The image forming apparatus 100 includes a controller unit 101 that controls an engine control unit 102, and the engine control unit 102. The controller unit 101 and the engine control unit 102 are connected via a video interface unit 103. The video interface unit 103 includes a serial communication unit and an image forming signal unit. The serial communication unit is used when the controller unit 101 transmits a command to the engine control unit 102, and the engine control unit 102 returns a status to the controller unit 101. The image forming signal unit is used to transmit/receive image data.

A main CPU 104 is a CPU (Central Processing Unit) that controls the entire engine control unit 102. A storage device 108 includes a ROM (Read Only Memory) and a RAM (Random Access Memory). The ROM stores a control program used to execute each flowchart to be described later. In addition, the RAM functions as a work area that temporarily stores various kinds of operation results or data obtaining results when a flowchart to be described later is executed.

An exposure control unit 105 controls exposure of the photosensitive drum 1. A charge control unit 106 performs control to apply a charge bias to the photosensitive drum 1. A development control unit 107 performs control to apply a developing bias to the developing roller 5.

A device communication unit 109 reads/writes information M0 from/to the electronic storage device M via an interface (electrical contact portion (not shown)) provided in the main body of the image forming apparatus 100.

A transfer control unit 113 performs control to apply a transfer bias to transfer a toner image on the photosensitive drum 1 to the transfer material P. A fixing control unit 114 performs energization control based on the detection result of a temperature detection element and controls a fixing temperature to fix the toner on the transfer material P. The image forming apparatus 100 according to this embodiment is controlled based on values set by the main CPU 104 in advance such that the transfer control unit 113 applies a transfer bias=+1600 V, and the fixing control unit 114 sets a fixing temperature=220° C.

A determination unit 120 determines, based on the information in the electronic storage device M, whether to change control. Upon determining based on identification information M3 and determination information M2 to change control, the determination unit 120 instructs change value data based on change information M1 in the electronic storage device M to the control units. In the example shown in this embodiment, a case in which transfer control and fixing control are changed will be described. Note that in FIG. 3, the determination unit 120 is provided independently of the main CPU 104, and has the same function as the main CPU 104. In addition, a description will be made below assuming that the determination unit 120 basically performs various kinds of determination processing. However, the present invention is not limited to this form. For example, various kinds of determination processing to be described later may be executed by the determination unit 120 in cooperation with the main CPU 104, or the main CPU 104 may be caused to execute all processes. Details of processing by the determination unit 120 will be described later with reference to the accompanying drawings.

(Electronic Storage Device)

The electronic storage device M provided in the process cartridge 10 will be described with reference to FIGS. 4A, 4B, and 4C. In this embodiment, an EEPROM (Electrically Erasable Programmable Read-Only Memory) is used as the electronic storage device M. In addition, the electronic storage device M is packaged into a predetermined shape covered with a resin, as shown in FIG. 4A, and includes electrical contact portions S used for communication with the main body of the image forming apparatus 100. The electronic storage device M stores information such as the date of the manufacture of the process cartridge 10, the serial number, the print page counter, the toner remaining amount, and parameters concerning process control (a bias and the like) needed to maintain a satisfactory output image. The process cartridge 10 is shipped in a state in which the initial values of the information are stored. Note that in this embodiment, an EEPROM is used as the electronic storage device M. However, the present invention is not limited to this, and another storage means, for example, an NVRAM (Non-Volatile RAM) may be used.

FIGS. 4B and 4C schematically show the structure of information stored in the electronic storage device M. FIG. 4B shows an example of information stored in the electronic storage device M of the process cartridge 10B, and FIG. 4C shows an example of information stored in the electronic storage device M of the process cartridge 10. The image forming apparatus 100 designates a desired address and transmits it to the electronic storage device M, thereby reading/writing desired information from/to the electronic storage device M.

FIG. 4B shows an example of the structure of the information M0 in the electronic storage device M provided in the process cartridge 10B of changed toner. The information M0 is stored by assigning predetermined information to a predetermined address. The information M0 stored in the electronic storage device M includes a first area 401, a second area 402, and a third area 403 in addition the above-described pieces of information. The first area 401 is an area to store the change information M1 used when changing the process control parameters of the image forming apparatus 100. The second area 402 is an area to store the determination information M2 used to determine the authenticity of the change information M1. The third area 403 is an area to store the identification information M3 representing whether the change information M1 is stored.

In the example shown in FIG. 4B, parameters corresponding to fixing temperature correction value data=−9° C. and transfer bias correction value data=−50 V are stored as the change information M1 in the first area 401. The determination information M2 in the second area 402 is information used to determine the authenticity (correctness) of the change information M1. More specifically, a Hash value derived by a Hash function using the change information M1 or a MAC value using a common key is used. The determination information M2 is obtained by converting these values into a digital signature. When such a Hash value or MAC value is used, the authenticity of an enormous amount of memory data, that is, whether the data is a correct value can be determined by short data. That is, the data amount of the determination information is smaller than the data amount of the change information. In this embodiment, a Hash value derived by a Hash function using the correction value data stored in the first area 401 is converted into a digital signature and stored. Note that the method of the Hash function or common key used here is not particularly limited. In addition, the information used to guarantee the correctness of information is not limited to that described above, and any other information or method may be used. Note that in the following description, the term "correctness" is used, but the term "correctness" can be replaced by, for example, the term "validity" or "proper".

The identification information M3="1" is stored in the third area 403 as information representing that the change information M1 is provided. Note that if the change information M1 is not provided, the identification information M3="0" is stored as shown in FIG. 4C. In this case, the first area 401 and the second area 402 are not used.

[Control Procedure]

Figure 1:
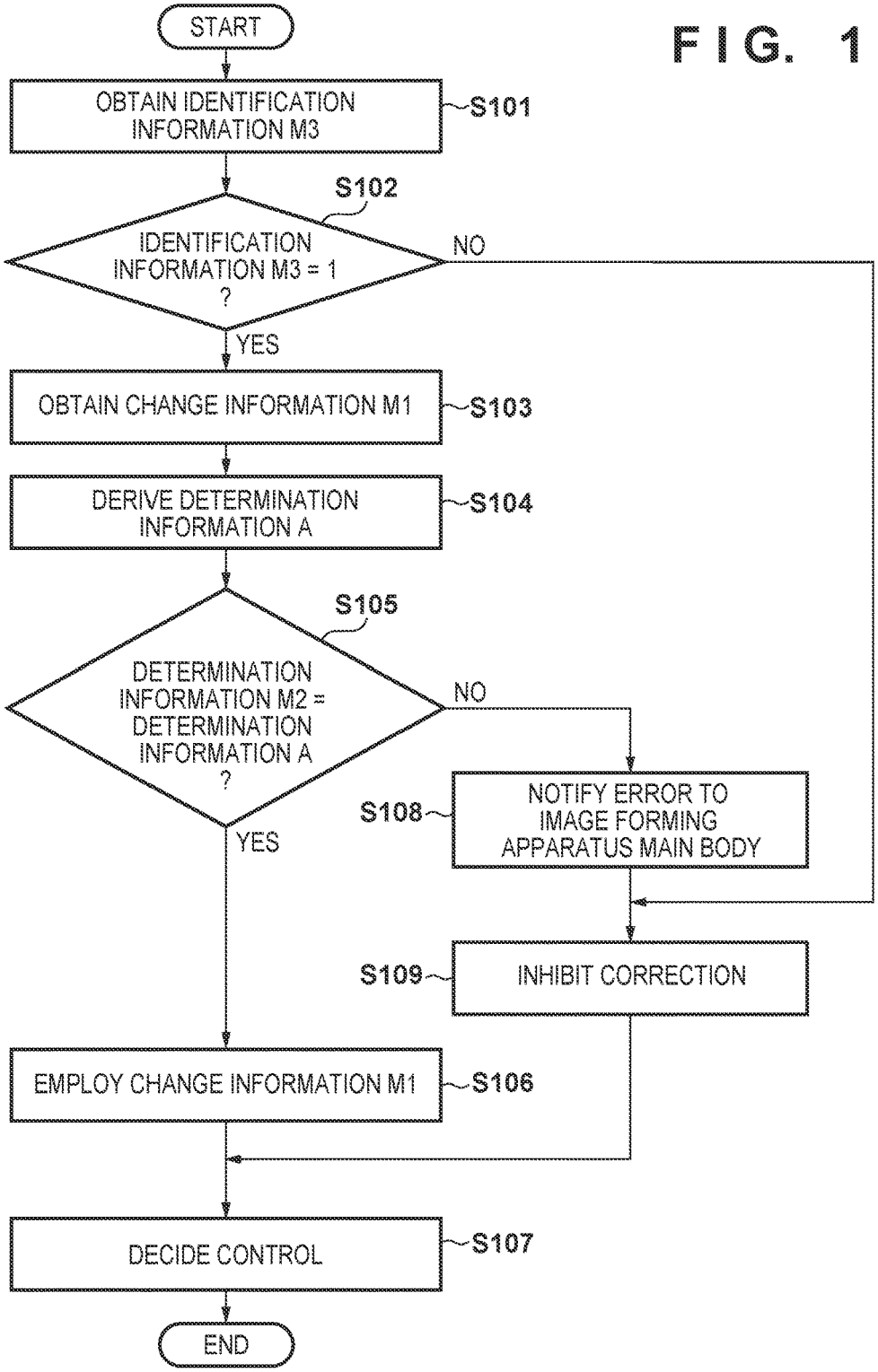
FIG. 1 is a flowchart of an image forming apparatus according to the first embodiment.

FIG. 1 shows the control procedure of the image forming apparatus 100 according to this embodiment. In this embodiment, when the main body of the image forming apparatus 100 is powered on, a state in which the electronic storage device M provided in the process cartridge 10 and the device communication unit 109 of the image forming apparatus 100 can start communication is set. Accordingly, the information M0 stored in the electronic storage device M is read out via the interface of the image forming apparatus 100, and the processing starts. Additionally, in the image forming apparatus 100 according to this embodiment, the transfer bias=+1600 V in the transfer control unit 113 and the fixing temperature=220° C. in the fixing control unit 114 are assumed to be defined in advance as standard operation conditions, as described above.

In step S101, the determination unit 120 obtains the identification information M3 from the information M0.

In step S102, the determination unit 120 determines whether the information of the identification information M3 is "1". If the information is 1 (YES in step S102), the process advances to step S103. If the information is not 1 (that is, the information is 0) (NO in step S102), the process advances to step S109.

In step S103, the determination unit 120 obtains the change information M1 from the information M0.

In step S104, the determination unit 120 derives determination information A based on the change information M1. Here, deriving means generating information. The determination information A according to this embodiment will be described using an example in which a digital signature A based on a Hash value derived by calculating a Hash function is used.

In step S105, the determination unit 120 compares the determination information A derived in step S104 with the determination information M2 included in the information M0. In this embodiment, the digital signature A derived in step S104 and the digital signature M2 stored in the electronic storage device M are compared. Upon determining, as the result of comparison, that the digital signature A matches the digital signature M2 (YES in step S105), the process advances to step S106. Upon determining that the digital signatures do not match (NO in step S105), the process advances to step S108.

In step S106, the determination unit 120 determines to employ the change information M1. In the example shown in FIG. 4B, the transfer bias correction value=−50 V and the fixing temperature correction value=−9° C., which are stored as the change information M1, are employed.

In step S107, the determination unit 120 decides to control the main body of the image forming apparatus 100 under the changed conditions. In an example in the case in which it is determined to employ the change information M1, transfer bias=+1600−50=+1550 V, and fixing temperature=220−9=211° C.

are set, and instructions are output to the transfer control unit 113 and the fixing control unit 114. Then, the processing procedure ends.

In step S108, the determination unit 120 notifies a data error to a display unit 27 of the main body of the image forming apparatus 100. This is because it is considered that the change information M1 stored in the electronic storage device M provided in the mounted process cartridge is rewritten for some reason such as noise.

In step S109, the determination unit 120 determines not to employ the change information of the change information M1. The process advances to step S107. In this case, in the control of step S107, transfer control and fixing control are performed using operation conditions defined in advance in the main body of the image forming apparatus 100. That is, in an example in the case in which it is determined not to employ the change information M1, transfer bias=+1600 V, and fixing temperature=220° C.

are set, and instructions are output to the transfer control unit 113 and the fixing control unit 114. Then, the processing procedure ends.

With the above-described processing, even when the process cartridge 10B of the changed toner is used, image formation according to the toner can be performed.

As described above, in this embodiment, when the change information M1 stored in the electronic storage device is employed, the correctness of the change information M1 can accurately be determined by the determination information M2. It is therefore possible to perform an appropriate operation of the image forming apparatus.

Second Embodiment

In the second embodiment of the present invention, a case in which common process cartridges are used, and process cartridges having the same structure can be mounted in a plurality of types of image forming apparatuses will be described.

A description will be made here assuming that the plurality of types of image forming apparatuses are image forming apparatuses 100A, 100B, and 100C in the order of release in the market. In addition, a description will be made assuming that the common process cartridges that are process cartridges storing different toners (printing materials) are process cartridges 10A, 10B, and 10C in the order of release in the market. That is, the process cartridges themselves have a common structure, and the toners stored in them are improved.

In this embodiment, assume a case in which the process cartridge 10C that can be mounted in the image forming apparatus 100C can be mounted even in the image forming apparatuses 100A and 100B released before the image forming apparatus 100C, as shown in FIG. 5A.

The toner stored in the process cartridge 10C released later in the market is assumed to have been more improved. For this reason, the optimum transfer bias and fixing temperature of the toner stored in the process cartridge 10C are lower than those of the toners stored in the process cartridges 10A and 10B, and the power consumption of the image forming apparatus 100C at the time of an operation can be suppressed low. Hence, when the process cartridge 10C can be mounted even in the image forming apparatuses 100A and 100B, it is possible to obtain a user merit that the power consumption of the image forming apparatuses already released in the market at the time of an operation can be suppressed low.

In this embodiment, an electronic storage device M provided in the process cartridge 10C includes a plurality of pieces of change information for the different image forming apparatuses, and includes determination information for determining the correctness of each change information.

(Image Forming Apparatus)

In this embodiment, three types of image forming apparatuses using different transfer bias conditions and fixing temperature conditions, as shown in FIG. 5B, are used. The rest of the arrangement is the same as the arrangement described in the first embodiment, and a description thereof will be omitted.

(Process Cartridge)

In this embodiment, process cartridges that store different toners will be described. More specifically, three types of process cartridges (toners) to be described below are used.

Process cartridge 10A that stores toner capable of obtaining an optimum image under the conditions (transfer bias=+1600 V, fixing temperature=220° C.) of the image forming apparatus A Process cartridge 10B that stores toner capable of obtaining an optimum image under the conditions (transfer bias=+1550 V, fixing temperature=211° C.) of the image forming apparatus B Process cartridge 10C that stores toner capable of obtaining an optimum image under the conditions (transfer bias=+1530 V, fixing temperature=200° C.) of the image forming apparatus C The mountability of the process cartridges for the image forming apparatuses is as follows, as shown in FIG. 5A. That is, process cartridge 10A: mountable in image forming apparatus 100A process cartridge 10B: mountable in image forming apparatuses 100A and 100B process cartridge 10C: mountable in image forming apparatuses 100A, 100B, and 100C Each process cartridge 10 includes the electronic storage device M.

(Electronic Storage Device)

FIGS. 6A to 6C schematically show examples of the structure of information stored in the electronic storage device M according to this embodiment. As in the first embodiment, information M0 stored in the electronic storage device M includes a first area 601, a second area 602, and a third area 603.

FIG. 6A shows an example of information stored in the electronic storage device M provided in the process cartridge 10A. In the third area 603, identification information M3="0", and change information M1 is not stored.

FIG. 6B shows an example of information stored in the electronic storage device M provided in the process cartridge 10B. In the third area 603, the identification information M3="1". In the first area 601, change information M1*a* is stored, which is information to be employed when the process cartridge 10B is mounted in the image forming apparatus 100A. More specifically, parameters corresponding to fixing temperature correction value data=−9° C. and transfer bias correction value data=−50 V are stored as the change information M1*a*. Additionally, as in the first embodiment, determination information M2*a* used to determine the correctness of the change information is stored in the second area 602. In this embodiment, the determination information M2*a* derived using the change information M1*a* is stored. The determination information M2*a* is obtained by converting a Hash value derived by a Hash function into a digital signature, as in the first embodiment.

FIG. 6C shows an example of information stored in the electronic storage device M provided in the process cartridge 10C. In the third area 603, the identification information M3="2". In the first area 601, the change information M1*a* and change information M1*b* are stored. The change information M1*a* and the change information M1*b* correspond to control information for image forming apparatuses of a plurality of generations. This allows the process cartridge 10C of the latest version to be mounted and used in the image forming apparatuses of the latest generation to the old generation. For example, assume that the image forming apparatus 100C or the process cartridge 10C is an upgraded image forming apparatus of the third generation. In this case, even in a case in which the process cartridge 10C is mounted in the image forming apparatus 100A or 100B corresponding to the first or second generation, the process cartridge 10C can be used in the image forming apparatuses of all generations by using the change information M1*a* and the change information M1*b*.

Referring back to FIGS. 6A to 6C, the change information M1*a* is information to be employed when the process cartridge 10C is mounted in the image forming apparatus 100B. The change information M1*b* is information to be employed when the process cartridge 10C is mounted in the image forming apparatus 100A. More specifically, parameters corresponding to fixing temperature correction value data=−11° C. and transfer bias correction value data=−20 V are stored as the change information M1*a*. In addition, parameters corresponding to fixing temperature correction value data=−20° C. and transfer bias correction value data=−70 V are stored as the change information M1*b*.

The relationship between the image forming apparatus 100A and the image forming apparatus 100B will be described here. These image forming apparatuses correspond to image forming apparatuses already distributed in the market before the release of the image forming apparatus 100C. The image forming apparatuses 100A to 100C have a common mechanical structure so that a common cartridge can be mounted. The image forming apparatus 100A is improved, and its specifications are changed to obtain the image forming apparatus 100B. Improvement and specification change are further reflected to obtain the image forming apparatus 100C.

Determination information M2 used to determine the correctness of the change information is stored in the second area 602, as in the first embodiment. In this embodiment, two pieces of determination information, that is, the determination information M2*a* derived using the change information M1*a* and determination information M2*b* derived using the change information M1*b* are stored. As in the first embodiment, the pieces of determination information M2*a* and M2*b* are obtained by converting Hash values derived by a Hash function into digital signatures.

In a case in which the process cartridge 10 has undergone many changes, and the identification information M3="2" is stored in the third area 603, as described above, the image forming apparatuses 100A and 100B corresponding to the identification information M3=0 and the identification information M3=1 are operating in the market. In this case, in the electronic storage device M of the newly changed process cartridge 10, pieces of control information for the image forming apparatuses 100A and 100B already operating in the market are stored in a predetermined area. Now, the pieces of control information correspond to the change information M1*a* and the change information M1*b*. The determination information M2*a* and the determination information M2*b* are used by a determination unit 120 to determine the correctness of these pieces of change information. Note that determining the correctness by the determination unit 120 corresponds to processing of determining whether each change information stored in the electronic storage device M matches original change information stored upon shipping from the factory.

[Control Procedure]

A control procedure according to this embodiment will be described with reference to FIGS. 7A, 7B and 8.

(Case of Image Forming Apparatus 100A)

A case in which the process cartridge 10A, the process cartridge 10B, or the process cartridge 10C is mounted in the image forming apparatus 100A will be described first with reference to FIGS. 7A and 7B. As in the first embodiment, when the main body of the image forming apparatus 100A is powered on, a state in which the electronic storage device M provided in the process cartridge 10A, the process cartridge 10B, or the process cartridge 10C and a device communication unit 109 of the image forming apparatus 100A can start communication is set. Accordingly, the information M0 stored in the electronic storage device M is read out via the interface of the image forming apparatus 100A, and the processing procedure starts. Additionally, as shown in FIG. 5B, in the image forming apparatus 100A according to this embodiment, the transfer bias=+1600 V in a transfer control unit 113 and the fixing temperature=220° C. in a fixing control unit 114 are assumed to be defined in advance as standard operation conditions.

In step S701, the determination unit 120 obtains the identification information M3 from the information M0.

In step S702, the determination unit 120 determines whether the identification information M3 is "0". If the identification information M3 is 0 (YES in step S702), the process advances to step S717. If the identification information M3 is not 0 (NO in step S702), the process advances to step S703.

In step S703, the determination unit 120 determines whether the identification information M3 is "1". If the identification information M3 is 1 (YES in step S703), the process advances to step S704. If the identification information M3 is not 1 (NO in step S703), the process advances to step S711.

In step S704, the determination unit 120 obtains the change information M1*a* from the information M0. When the change information M1*a* stored in the first area is first control information, the change information M1*b* obtained in step S711 to be described later can be called second control information.

In step S705, the determination unit 120 derives determination information A based on the change information M1*a*. Here, deriving means processing or generating information. In this embodiment, the determination information A is a digital signature A based on a Hash value derived using a Hash function.

In step S706, the determination unit 120 compares the determination information A derived in step S705 with the determination information M2*a* included in the information M0. Upon determining, as the result of comparison, that the determination information M2*a* matches the determination information A (YES in step S706), the process advances to step S707. Upon determining that the pieces of determination information do not match (NO in step S706), the process advances to step S709.

In step S707, the determination unit 120 determines to employ the change information M1*a*. In the example of this embodiment, the transfer bias correction value=−50 V and the fixing temperature correction value=−9° C., which are stored as the change information M1*a*, are employed.

In step S708, the determination unit 120 decides to control the main body of the image forming apparatus 100A under the changed conditions. In an example in the case in which it is determined to employ the change information M1*a*, transfer bias=+1600−50=+1550 V, and fixing temperature=220−9=211° C.

are set, and instructions are output to the transfer control unit 113 and the fixing control unit 114. Then, the processing procedure ends.

In step S709, the determination unit 120 notifies a data error to a display unit 27 of the main body of the image forming apparatus 100A. This is because it is considered that the change information M1*a* is rewritten for some reason such as noise.

In step S710, the determination unit 120 determines not to employ the change information M1*a*. After that, the process advances to step S708 to perform control using uncorrected control parameters.

If the identification information is not "1" in step S703, the determination unit 120 obtains the change information M1*b* from the information M0 in step S711. In this way, in steps S704 and S711, the determination unit 120 can selectively obtain appropriate change information (control information) from the change information M1*a* and the change information M1*b* in accordance with the contents of the obtained identification information M3.

In step S712, the determination unit 120 derives determination information B based on the change information M1*b*. Here, deriving means processing or generating information.

In step S713, the determination unit 120 compares the determination information B derived in step S712 with the determination information M2*b* included in the information M0. Upon determining, as the result of comparison, that the determination information M2*b* matches the determination information B (YES in step S713), the process advances to step S714. Upon determining that the pieces of determination information do not match (NO in step S713), the process advances to step S715.

In this way, in steps S706 and S713, the determination unit 120 can selectively obtain the appropriate determination information M2 from the determination information M2*a* and the determination information M2*b* in accordance with the contents of the obtained identification information M3, and determine the correctness based on the determination information M2.

In addition, by the processes of steps S706 and S713 by the determination unit 120, each image forming apparatus can appropriately be caused to use the latest process cartridge 10 even in a case in which the image forming apparatuses (100A, 100B, and 100C) corresponding to a plurality of pieces of identification information M3 are already distributed in the market. That is, since the determination unit 120 confirms the correctness (coincidence from the original) for each of the change information M1*a* and the change information M1*b*, it is possible to cope with the state in which the image forming apparatuses corresponding to the plurality of pieces of identification information M3 are already distributed in the market while ensuring safety.

In step S714, the determination unit 120 determines to employ the change information M1*b*. In the example of this embodiment, the transfer bias correction value=−70 V and the fixing temperature correction value=−20° C., which are stored as the change information M1*b*, are employed. After that, the process advances to step S708 to decide to control the main body of the image forming apparatus 100A under the changed conditions. In an example in the case in which it is determined to employ the change information M1*b*, transfer bias=+1600−70=+1530 V, and fixing temperature=220−20=200° C.

are set, and instructions are output to the transfer control unit 113 and the fixing control unit 114. Then, the processing procedure ends.

In step S715, the determination unit 120 notifies a data error to the display unit 27 of the main body of the image forming apparatus 100A. This is because it is considered that the change information M1*b* is rewritten for some reason such as noise.

In step S716, the determination unit 120 determines not to employ the change information M1*b*. After that, the process advances to step S708 to perform control using uncorrected values.

In step S717, the determination unit 120 determines not to employ the change information M. Then, the process advances to step S708. In this case, in the control of step S708, transfer control and fixing control are performed using control values set in advance in the main body of the image forming apparatus 100A. That is, in an example in the case in which it is determined not to employ the change information M, transfer bias=+1600 V, and fixing temperature=220° C.

are set, and instructions are output to the transfer control unit 113 and the fixing control unit 114. Then, the processing procedure ends. Note that even when it is determined in step S709 or S716 not to employ the change information M1*a* or M1*b*, control is performed using the same control parameters.

As described above, even in a case in which the process cartridge is mounted in the image forming apparatus 100A, it is possible to determine the correctness of the change information and perform an appropriate image forming operation.

(Case of Image Forming Apparatus 100B)

A case in which the process cartridge 10C is mounted in the image forming apparatus 100B will be described next with reference to FIG. 8. As in the above-described case, when the main body of the image forming apparatus 100B is powered on, a state in which the electronic storage device M provided in the process cartridge 10C and the device communication unit 109 of the image forming apparatus 100B can start communication is set. Accordingly, the information M0 stored in the electronic storage device M is read out via the interface of the image forming apparatus 100B, and the processing starts. Additionally, as shown in FIG. 5B, in the image forming apparatus 100C according to this embodiment, the transfer bias=+1550 V in the transfer control unit 113 and the fixing temperature=211° C. in the fixing control unit 114 are assumed to be defined in advance as standard operation conditions.

In step S801, the determination unit 120 obtains the identification information M3 from the information M0.

In step S802, the determination unit 120 determines whether the identification information M3 is "0". If the identification information M3 is 0 (YES in step S802), the process advances to step S811. If the identification information M3 is not 0 (NO in step S802), the process advances to step S803.

In step S803, the determination unit 120 determines whether the identification information M3 is "1". If the identification information M3 is 1 (YES in step S803), the process advances to step S812. If the identification information M3 is not 1 (NO in step S803), the process advances to step S804.

Figure 7A:
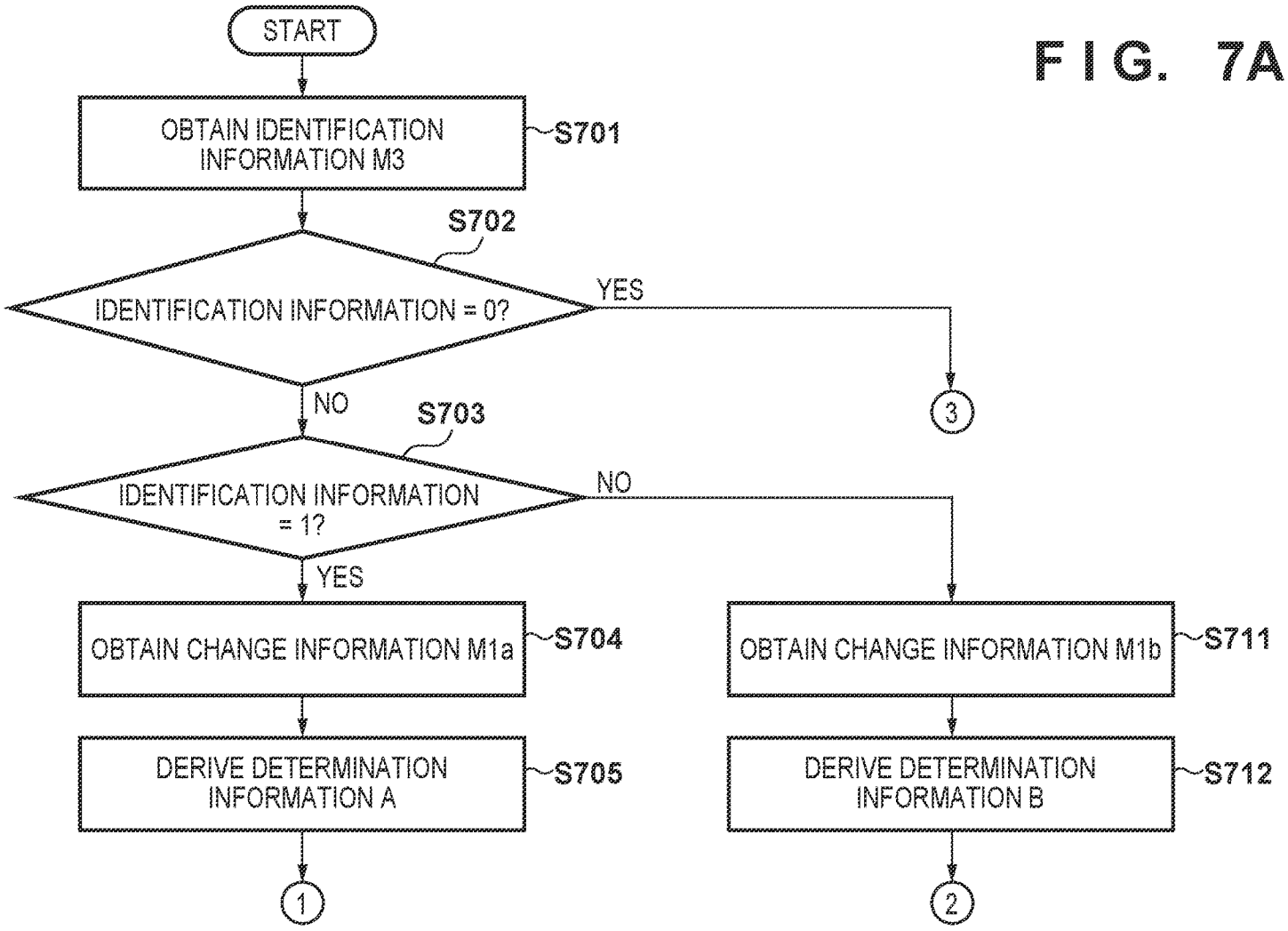
FIGS. 7A and 7B are flowcharts of an image forming apparatus C according to the second embodiment.
Figure 7B:
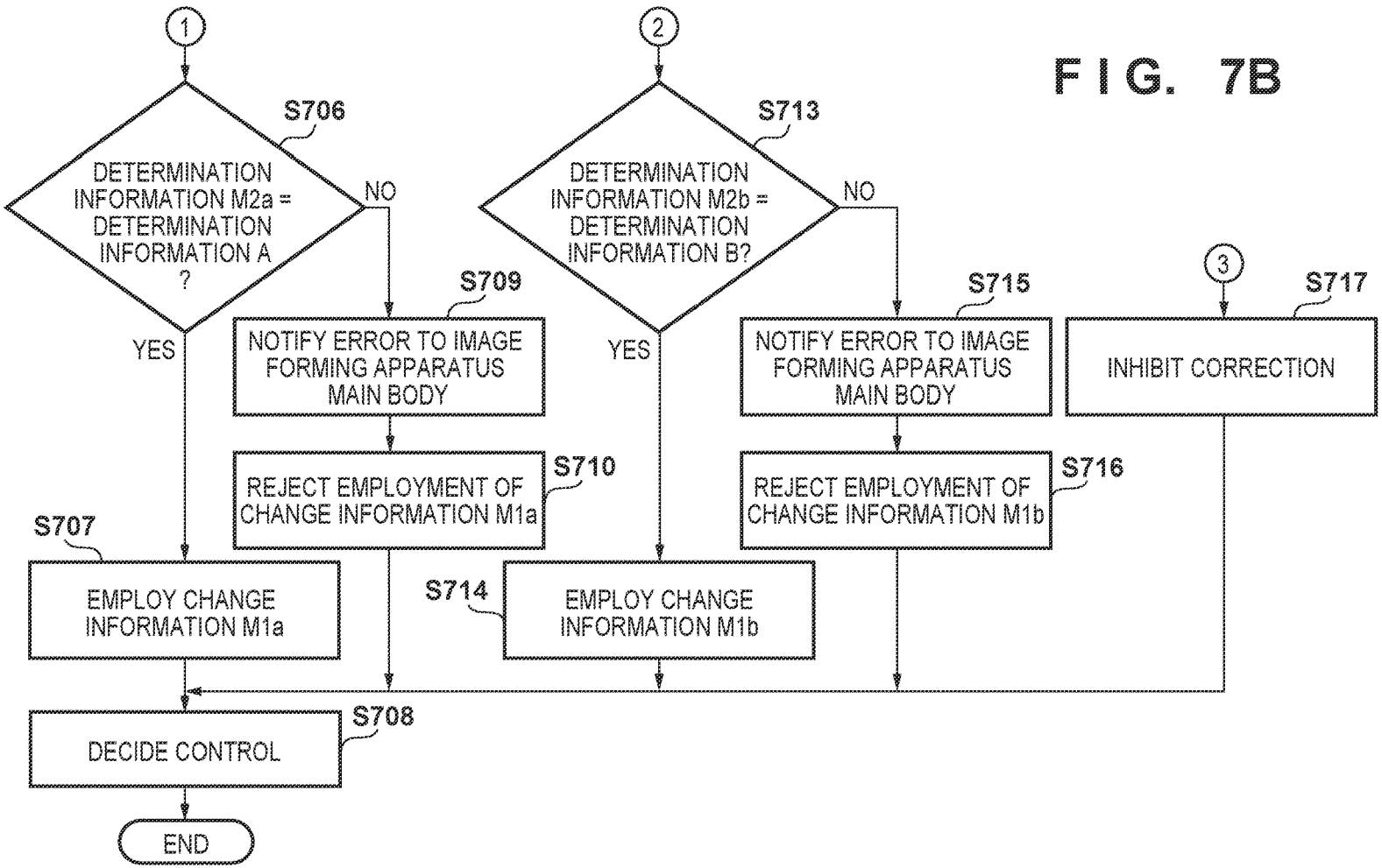
Figure 8:
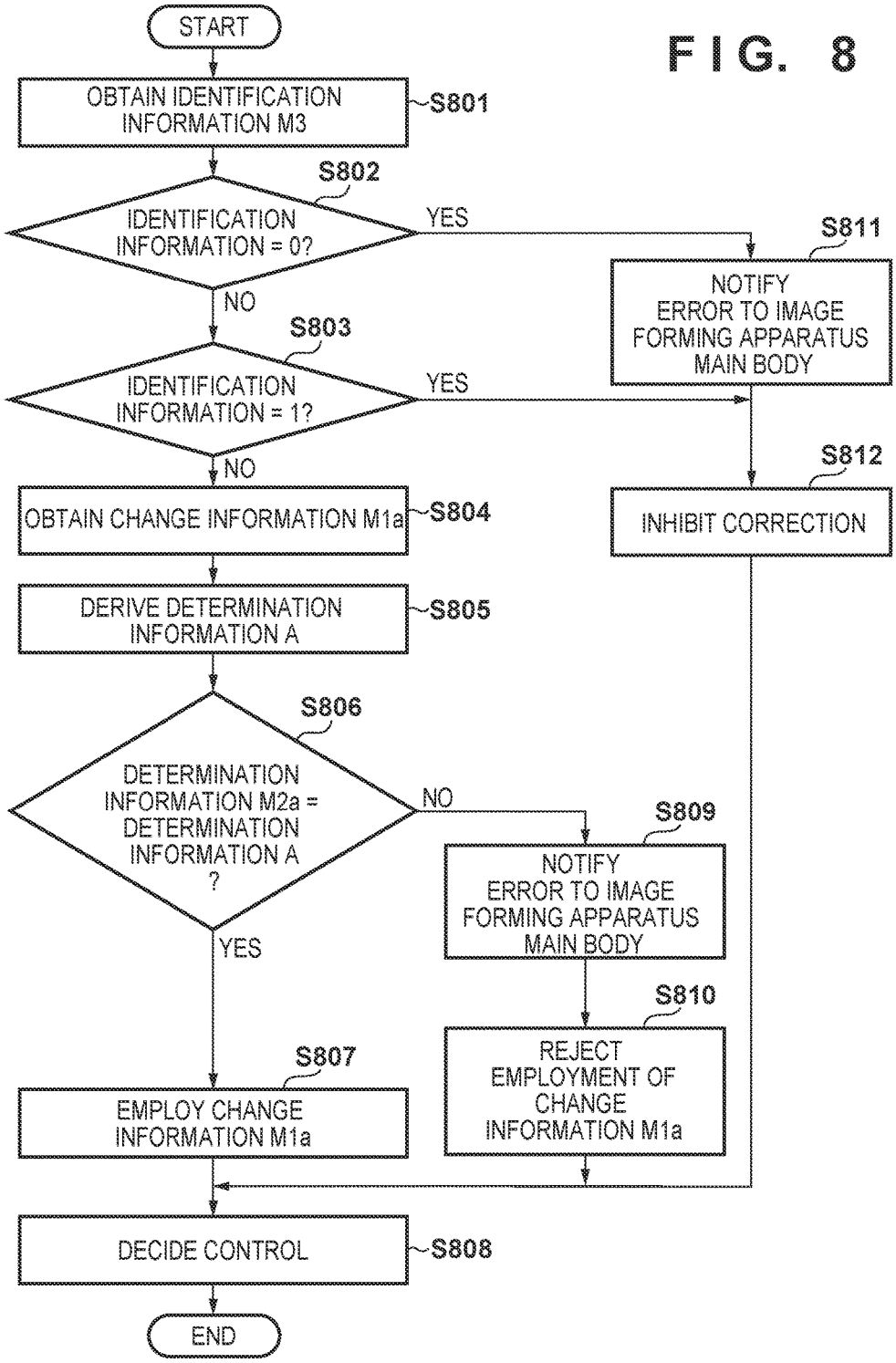
FIG. 8 is a flowchart of an image forming apparatus B according to the second embodiment.

The processes of steps S804 to S810 are the same as those of steps S704 to S710 shown in FIGS. 7A and 7B, and a detailed description thereof will be omitted. Hence, in this case as well, if it is determined to employ the change information M1*a*, transfer bias=+1550−20=+1530 V, and fixing temperature=211−11=200° C.

are set, and instructions are output to the transfer control unit 113 and the fixing control unit 114. In addition, if it is determined not to employ the change information M1*a*, transfer bias=+1550 V, and fixing temperature=211° C.

are set, and instructions are output to the transfer control unit 113 and the fixing control unit 114.

In step S811, the determination unit 120 notifies a data error to the display unit 27 of the main body of the image forming apparatus 100B. This is because if the identification information M3 is "0", it indicates that the process cartridge cannot be mounted in the image forming apparatus 100B, and this is notified.

In step S812, the determination unit 120 determines not to employ the change information M1. Then, the process advances to step S808. In this case, in the control of step S808, transfer control and fixing control are performed using control values set in advance in the main body of the image forming apparatus 100B. That is, in an example in the case in which it is determined not to employ the change information M1, transfer bias=+1550 V, and fixing temperature=211° C.

are set, and instructions are output to the transfer control unit 113 and the fixing control unit 114.

As described above, even in a case in which the process cartridge is mounted the image forming apparatus B, it is possible to determine the correctness of the change information and perform an appropriate image forming operation. Hence, even in the case of the common process cartridge, the correctness of the change information stored in the electronic storage device is determined, and an appropriate image forming operation is performed. Hence, when employing the change information M1 stored in the electronic storage device, since the correctness of the change information M1 can accurately be determined based on the determination information M2, an appropriate operation of the image forming apparatus can be performed.

Note that the set value of the identification information M3 and the range (data amount) of the (used) first area in which the change information is stored in the electronic storage device vary in accordance with the corresponding relationship between the process cartridges and the image forming apparatuses shown in FIG. 5A.

Additionally, in the above-described example, to simplify the description, values such as "1" and "2" are used as the identification information M3 in a case in which the change information is stored. However, for example, the value of the identification information may be information for uniquely identifying the type (model) of the image forming apparatus. For example, the model number of a released image forming apparatus, or the like may be used. In addition, the change information that is a process control parameter is ideally provided in accordance with each image forming apparatus. In fact, the change information is actually prepared for each minor change of the image forming apparatus 100 or the process cartridge. In this case, the identification information M3 is set while being changed for each minor change of the image forming apparatus 100 or the process cartridge. For example, assume a case in which each of the image forming apparatuses 100A, 100B, and 100C described above copes with a minor change, and the process cartridges 10A, 10B, and 10C are released in correspondence with the image forming apparatuses. In this case, the identification information M3 is individually set for the three different types of process cartridges 10A, 10B, and 10C.

Furthermore, in the above-described example, if it is determined not to employ the change information (steps S710 and S716 in FIG. 7B and step S810 in FIG. 8), control is performed such that the image forming apparatus operates using uncorrected control parameters. However, the present invention is not limited to this. For example, after an error is detected, the processing may wait until a user instruction or operation is input.

Third Embodiment

In the second embodiment, when, for example, the image forming apparatus 100A reads out the different identification information M3, the reference address at which the change information is read out from the electronic storage device M is different. For example, in FIGS. 7A and 7B, if the identification information M3=1, the determination unit 120 reads out the change information M1 from a start address 11*h*. In addition, if the identification information M3=2, the determination unit 120 reads out the change information M1 from a start address 31*h*. Even if the identification information M3 is the same (for example, M3=2), the read address changes depending on whether the apparatus that obtains the information is the image forming apparatus 100A or 100B. For example, when the image forming apparatus 100A reads out the identification information M3=2, the change information M1 is read out from the start address 31*h*. When the image forming apparatus 100B reads out the identification information M3=2, the change information M1 is read out from the start address 11*h*.

A description has been made above assuming that the types of identification information M3 and the link information of the change information M1 to be read out are incorporated in advance in the control program of each image forming apparatus. However, details of linking the identification information M3 and the start address of the change information M1 to be read out are not limited to this. This will be described below in detail.

A table shown in FIG. 9A represents an address of an electronic storage device M from which change information M1 is read out when each image forming apparatus (determination unit 120) reads out identification information M3 in the second embodiment. Details of the relationship in FIG. 9A are shown in FIGS. 6A to 8. However, the corresponding relationship between the identification information M3 and the types of image forming apparatuses held by the electronic storage device M is not limited to this.

For example, the corresponding relationship between the identification information M3 and the addresses shown in FIG. 9B may be incorporated in the control program of each image forming apparatus, and the determination unit 120 of each image forming apparatus may obtain a read start address as shown in the table of FIG. 9B in accordance with the identification information M3 to be read out. In this case, the flowcharts of FIGS. 7A, 7B and 8 are executed in accordance with the obtained address. For example, in the flowcharts of FIGS. 7A and 7B, when the determination unit 120 of an image forming apparatus 100A reads out the identification information M3 of "2" from the electronic storage device M, the determination unit 120 reads out change information M1*b* from the start address 11*h* of the electronic storage device M. In this case, the change information M1*b* is stored from the start address 11*h* of the electronic storage device M.

In addition, a description has been made assuming that the corresponding relationship of the read start addresses of the identification information M3 and the change information M1 described with reference to FIGS. 9A and 9B is incorporated in the control program (firmware) of each image forming apparatus. However, the present invention is not limited to this form. For example, a reference address for each model may be stored at a predetermined address of the electronic storage device M, and the determination unit 120 may read a reference address that matches the model of the own apparatus and read out the change information M1 in accordance with the obtained reference address. FIGS. 9C and 9D each show a state in which a reference address for each model is stored in correspondence with each identification information M3. For example, the process cartridge of the identification information M3=2 stores the corresponding relationship shown in FIG. 9D at a predetermined address. Note that a model A corresponds to the image forming apparatus 100A, and a model B corresponds to an image forming apparatus 100B. Additionally, which area of the electronic storage device M stores the reference address is assumed to be incorporated in advance in the control program of each image forming apparatus.

Figure 10A:
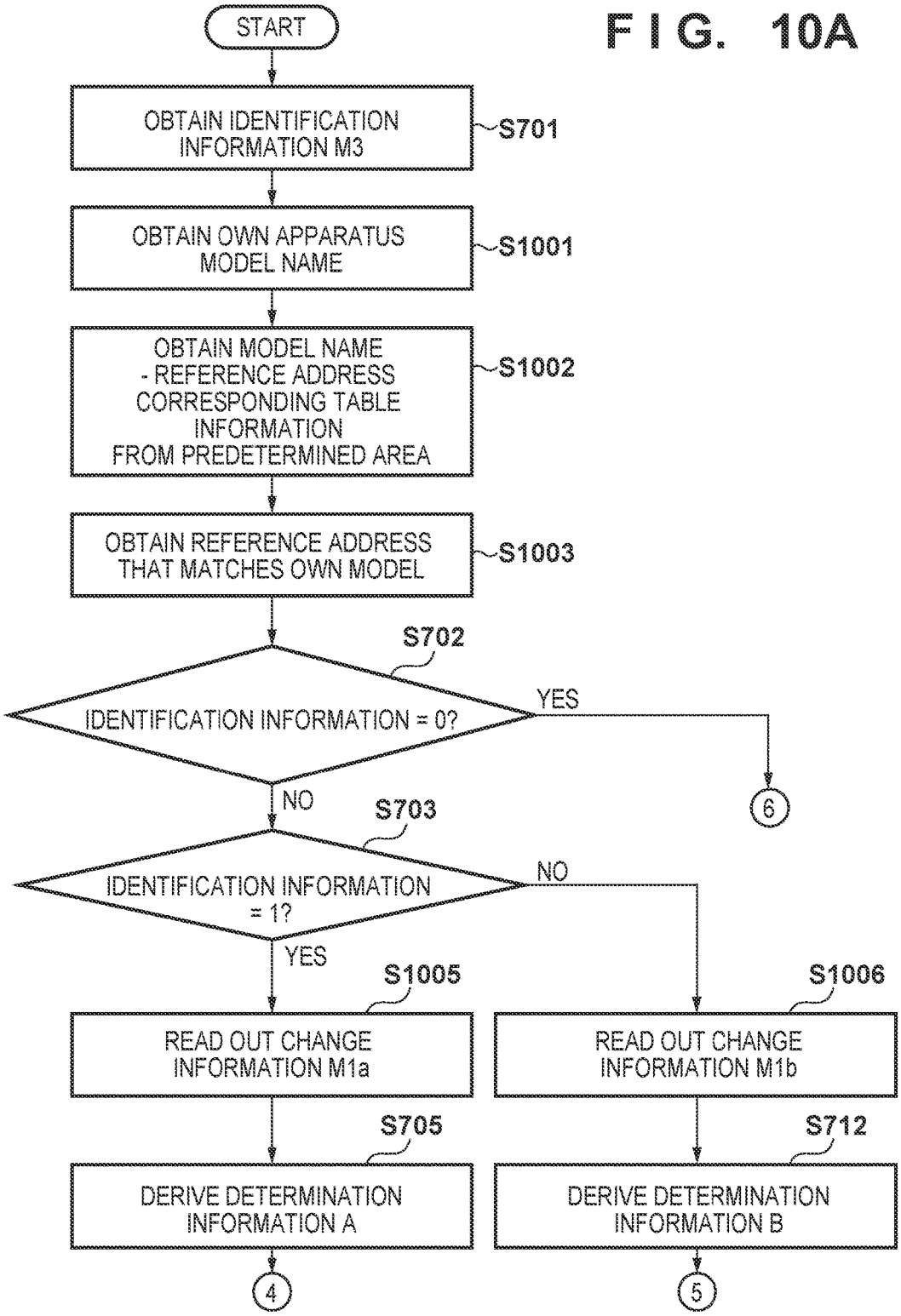
FIGS. 10A and 10B are flowcharts of an image forming apparatus according to the third embodiment.
Figure 10B:
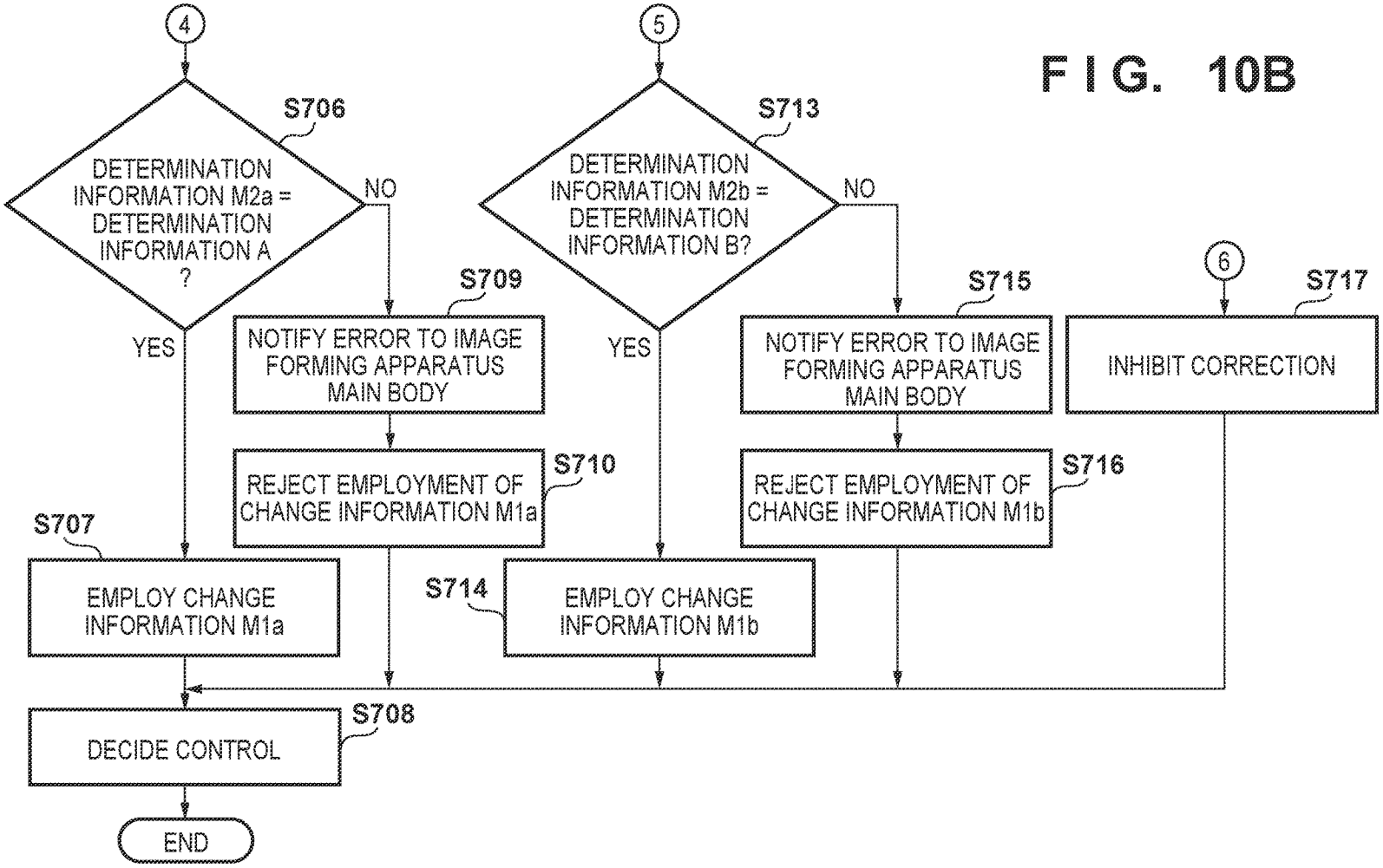

FIGS. 10A and 10B show a control procedure in a case in which a process cartridge is mounted in the image forming apparatus 100A. The same step numbers as in FIGS. 7A and 7B denote the same processes, and a repetitive description thereof will be omitted.

After step S701, in step S1001, the determination unit 120 of the image forming apparatus 100A obtains the model name of the own apparatus. The model name is stored in a predetermined area of a storage device 108. For the image forming apparatus 100A, the information of the model A is obtained. In addition, the model B corresponds to the image forming apparatus 100B, and a model C corresponds to an image forming apparatus 100C.

In step S1002, the determination unit 120 obtains the corresponding table information of the model names and the reference addresses from the predetermined area of the electronic storage device M via a device communication unit 109. When a process cartridge that stores the identification information M3=1 is mounted in the apparatus main body, table information corresponding to FIG. 9C is obtained from the electronic storage device M. When a process cartridge that stores the identification information M3=2 is mounted in the apparatus main body, table information shown in FIG. 9D is obtained from the electronic storage device M.

In step S1003, the determination unit 120 obtains a reference address that matches the own model name based on the model name obtained in step S1001 and the information of the corresponding table obtained in step S1002.

If the read identification information M3 is "1" in step S703, since the reference address 11*h* is obtained from the information of the corresponding relationship shown in FIG. 9C, the determination unit 120 reads out change information M1*a* from the address (step S1005). In addition, if the read identification information M3 is "2" in step S703, since a reference address 31*h* is obtained from the information representing the corresponding relationship shown in FIG. 9D, the determination unit 120 reads out the change information M1*b* from the address. The remaining processes from then on are the same as described with reference to FIGS. 7A and 7B, and a detailed description thereof will be omitted here.

In addition, the information stored in the electronic storage device M is not limited to the contents shown in FIG. 9D. Instead, for example, the corresponding relationship between the models and the reference addresses shown in FIG. 9B may be stored.

Furthermore, the case of the image forming apparatus 100A has been described with reference to FIGS. 10A and 10B. This also basically applies to the case of the image forming apparatus 100B. That is, the determination unit 120 of the image forming apparatus 100B executes the processes of steps S1001 to S1003 and obtains a reference address, as described above. The determination unit 120 then executes the processing from step S802 in FIG. 8 based on the obtained reference address.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-112026, filed Jun. 6, 2017, and No. 2018-056751, filed Mar. 23, 2018, which are hereby incorporated by reference herein in their entirety.

What is claimed is:

1. An image forming apparatus to which a cartridge including an electronic storage device can detachably be attached, comprising:

at least one memory storing instructions; and at least one processor that, upon executing instructions stored in the at least one memory, functions to obtain control information used for image formation from a first area of the electronic storage device and obtain determination information used to determine correctness of the control information stored in the first area from a second area configured to store the determination information;

determine the correctness of the control information based on the control information and the determination information;

control image formation, if it is determined that the control information is correct, using the obtained control information, and generate generated determination information based on the control information, wherein the electronic storage device includes a third area configured to store identification information used to identify the cartridge, the determination information is obtained from the second area based on the identification information obtained from the third area, the generated determination information is generated based on the obtained control information, and the correctness of the control information is determined based on comparison between the determination information based on the identification information and the generated determination information.

2. The apparatus according to claim 1, wherein the obtaining obtains the identification information from the third area, the obtaining selects the control information according to the obtained identification information from first control information and second control information stored in the first area, and selects, from the second area, the determination information based on the obtained identification information from first determination information and second determination information, the generated determination information is generated from the selected control information; and the correctness of the selected control information is determined based on comparison between the selected determination information and the generated determination information.

3. The apparatus according to claim 1, wherein the determination information is information derived using original control information.

4. The apparatus according to claim 1, wherein the control information is information concerning at least one of transfer control to transfer a toner image onto a transfer material in the image formation and fixing control to fix the toner image transferred onto the transfer material.

5. The apparatus according to claim 1, wherein determination of the correctness is determination of coincidence with original control information.

6. An electronic storage device provided in a cartridge that can detachably be attached to an image forming apparatus, comprising:

a first area configured to store control information used for image formation by the image forming apparatus;

a second area configured to store determination information used to determine correctness of the control information stored in the first area; and a third area configured to store identification information used to identify the cartridge, wherein, by the image forming apparatus, the determination information based on the identification information obtained from the third area is obtained from the second area, generated determination information is generated based on the obtained control information, and the correctness of the control information is determined based on comparison between the determination information based on the identification information and the generated determination information.

7. The device according to claim 6, wherein the determination information stored in the second area is information derived using original control information.

8. The device according to claim 7, wherein the determination information is derived using a Hash function.

9. The device according to claim 6, wherein the determination information has a data amount smaller than the control information stored in the first area.

10. The device according to claim 6, wherein the control information stored in the first area is information used to correct a control parameter used for the image formation by the image forming apparatus.

11. The device according to claim 6, wherein the control information is information concerning at least one of transfer control to transfer a toner image onto a transfer material in the image formation and fixing control to fix the toner image transferred onto the transfer material.

12. The device according to claim 11, wherein the information concerning the transfer control is information used to change a value of a voltage used in the transfer control.

13. The device according to claim 11, wherein the information concerning the fixing control is information used to change a value of a temperature used in the fixing control.

14. The device according to claim 6, wherein determination of the correctness is determination of coincidence with original control information.

15. The device according to claim 6, further comprising a third area configured to store identification information used to identify the cartridge.

16. A cartridge that can detachably be attached to an image forming apparatus, comprising:

an electronic storage device; and a storage unit configured to store a developing material, wherein the electronic storage device comprises:

a first area configured to store control information used for image formation by the image forming apparatus;

a second area configured to store determination information used to determine correctness of the control information stored in the first area; and a third area configured to store identification information used to identify the cartridge, wherein, by the image forming apparatus, the determination information based on the identification information obtained from the third area is obtained from the second area, generated determination information is generated based on the obtained control information, and the correctness of the control information is determined based on comparison between the determination information based on the identification information and the generated determination information.

17. A method of controlling an image forming apparatus to which a cartridge including an electronic storage device configured to store information can detachably be attached, wherein the electronic storage device includes:

a first area configured to store control information used for image formation by the image forming apparatus; and a second area configured to store determination information used to determine correctness of the control information stored in the first area, a third area configured to store identification information used to identify the cartridge, and the method comprises:

deriving first information using control information stored in the first area;

obtaining, from the second area, the determination information based on the identification information stored in the third area;

determining, based on comparison between the first information and the determination information stored in the second area, whether the control information stored in the first area is correct; and if it is determined in the determining that the control information is correct, correcting a control parameter used for image formation using the control information stored in the first area and controlling the image formation.

18. The method according to claim 17, wherein if it is determined in the determining that the control information is not correct, correction of the control parameter using the control information stored in the first area is not performed.

19. The method according to claim 17, further comprising notifying an error if it is determined in the determining that the control information is not correct.

20. The method according to claim 17, wherein the electronic storage device further includes a third area configured to store identification information representing a correspondence between the image forming apparatus and the control information stored in the first area, and in the determining, determination is performed, based on the identification information, using, of the control information stored in the first area, control information corresponding to the image forming apparatus.

21. The method according to claim 20, further comprising notifying an error if it is determined based on the identification information that the control information corresponding to the image forming apparatus is not stored in the first area.

22. The method according to claim 17, wherein determination of the correctness is determination of coincidence with original control information.

23. An image forming apparatus to which a cartridge including an electronic storage device can detachably be attached, comprising:

at least one memory storing instructions; and at least one processor that, upon executing instructions stored in the at least one memory, functions to obtain identification information used to identify the cartridge and determination information corresponding to the identification information from the electronic storage device; and control image formation, wherein the electronic storage device stores first control information for a first image forming apparatus and second control information for a second image forming apparatus of a version different from the first image forming apparatus, the control information corresponding to said image forming apparatus is selectively selected from the first control information and the second control information in the electronic storage device, generated determination information is generated based on the selected control information, the correctness of the selected control information is determined based on comparison between the determination information based on the identification information and the generated determination information, and image formation is controlled using the selected control information based on a determination result of the correctness of the selected control information.

* * * * *